US005190616A

United States Patent [19]

Akimoto et al.

[11] Patent Number: 5,190,616

[45] Date of Patent: Mar. 2, 1993

[54] SELF-EMULSIFYING SIZING AGENTS

[76] Inventors: Shin-ichi Akimoto, 1326-28, Zushimachi, Machida-shi, Tokyo 194-02; Susumu Honda, 7-9, Minamiyukigaya 4-chome, Ohta-ku, Tokyo 145; Tohru Yasukohchi, 3-10-404, Fujisaki 2-chome, Kawasaki-ku, Kawasaki-shi, Kanagawa-ken 210; Hideki Takahashi, 2-49, Kaminotani 4-chome, Suma-ku, Kohbe-shi, Hyogo-ken 654-01; Fujio Takahashi, 1-13-207, Higashinaruocho 1-chome, Nishinomiya-shi, Hyogo-ken 663, all of Japan

[21] Appl. No.: 566,462

[22] PCT Filed: Dec. 26, 1989

[86] PCT No.: PCT/JP89/01305

§ 371 Date: Oct. 16, 1990

§ 102(e) Date: Oct. 16, 1990

[87] PCT Pub. No.: WO90/07609

PCT Pub. Date: Jul. 12, 1990

[30] Foreign Application Priority Data

Dec. 27, 1988 [JP] Japan ..... 63-327821

[51] Int. Cl.[5] ..... D21H 17/15

[52] U.S. Cl. ..... 162/158; 162/164.1; 162/168.1; 162/179

[58] Field of Search ..... 162/158, 168.1, 179, 162/164.1; 106/287.23, 287.24

[56] References Cited

U.S. PATENT DOCUMENTS

| | | | |
|---|---|---|---|
| 4,529,447 | 7/1985 | Okada et al. | 162/158 |
| 4,946,904 | 8/1990 | Akimoto et al. | 525/327.8 |
| 4,946,918 | 8/1990 | Akiyama et al. | 526/271 |

FOREIGN PATENT DOCUMENTS

| | | | |
|---|---|---|---|
| 58-147413 | 9/1983 | Japan . | |
| 59-53798 | 3/1984 | Japan | 162/168.1 |

*Primary Examiner*—Peter Chin

*Attorney, Agent, or Firm*—Antonelli, Terry, Stout & Kraus

[57] ABSTRACT

The invention relates to self-emulsifying sizing agents which are able to have long shelf stability and easily formable emulsifiable liquid when the agents are mixed with water, and which are suitable for treating paper. These sizing agents comprise of copolymers of particular polyoxyalkylene alkenyl ethers and maleic anhydride. Further, these sizing agents comprise of the above copolymers and particular alkenylsuccinic anhydrides or particular ketene dimers.

5 Claims, No Drawings

SELF-EMULSIFYING SIZING AGENTS

TECHNICAL FIELD

The present invention relates to self-emulsifying sizing agents, which are particularly able to have long shelf stability and easily formable emulsifiable liquid by mixing water.

BACKGROUND ART

As a reactive sizing agent which is usable for paper industry, alkenylsuccinic anhydrides and ketene dimers are known ("Pulp and Chemistry and Chemical Technology" Third Edition, JOHN WILEY & SONS, Inc. NEW YORK (1981).

α-Olefin-maleic anhydride copolymers are also disclosed in Japanese Patent Publication No. 62-25798/1987.

As emulsifying agents, addition products of ethylene oxides to higher alcohols, alkylphenols, higher fatty acids or the like. (Oil chemistry, vol. 10, p.282 (1961) are usually used, and these addition products have free hydroxyl groups.

As a treating agent for sizing paper, an emulsifiable liquid which is obtained by mixing a sizing agent and an emulsifying agent and then by mixing the mixture and water is usable.

Accordingly, if a mixture of a sizing agent and an emulsifying agent has long shelf stability, it is conveniently usable for sizing paper. However, since the conventional emulsifying agent has free hydroxyl groups, there are problems that the emulsifying agent and the sizing agent are reacted and the sizing effect is lowered during the mixture is preserved.

Furthermore, since the conventional sizing agent has remarkable hydrophobic nature, it is required to emulsify the sizing agent with an emulsifying agent. The emulsifying agent has hydrophilic nature, so that the mixture of the sizing agent and the emulsifying agent often shows insufficient sizing effect.

An object of the present invention is to provide sizing agents which are easily emulsifiable by mixing water, which have excellent sizing effect, long shelf stability and little lowered sizing effect.

Another object of the present invention is to provide emulsifying agents which have long shelf stability even if the emulsifying agents are mixed with conventional alkenylsuccinic anhydrides or ketene dimers, and have little lowered sizing effect during the mixtures are preserved.

DISCLOSURE OF INVENTION

The inventors of the present invention earnestly studied and they found that copolymers of polyoxyalkylene alkenyl ethers having a specific structure and maleic anhydride are stable and self-emulsifiable and have excellent sizing effect. Further, they found that the copolymers act so as to emulsify alkenylsuccinic anhydrides or ketene dimers which have used as sizing agents, and that the copolymers have good stability even if they are mixed with alkenylsuccinic anhydrides or ketene dimers, because there is no reaction between the copolymers and the sizing agents.

Namely, the present invention resides in a self-emulsifying sizing agent which comprises a copolymer of polyoxyalkylene alkenyl ether and maleic anhydride, the polyoxyalkylene alkenyl ether being represented by the general formula (1):

$$Z\begin{cases}[O(AO)_aR]_l \\ [O(AO)_bR^1]_m \\ [O(AO)_cH]_n\end{cases} \quad (1)$$

wherein Z is a residue of compounds having 2–8 hydroxy groups, AO is one or more oxyalkylene groups of 2–18 carbon atoms, however, the bond may be under a random or blocking condition when AO is two oxyalkylene groups or more, R is an alkenyl group of 2–5 carbon atoms, $R^1$ is a hydrocarbon or an acyl group of 1–24 carbon atoms, $a \geqq 0$, $b \geqq 0$, $c \geqq 0$, $l = 1–2$, $m = 0–7$, $0 \leqq n/(l+m+n) \leqq \frac{1}{3}$, $al+bm+cn = 1–500$ and $l+m+n = 2–8$.

In the general formula (1), as the compounds having 2–8 hydroxy groups in which Z is a residue, glycols such as ethylene glycol, propylene glycol, butylene glycol, hexylene glycol, styrene glycol, alkylene glycol of 8–18 carbon atoms, and neopentyl glycol, polyols such as glycerin, diglycerin, polyglycerin, trimethyrolethane, trimethyrolpropane, 1,3,5-pentanetriol, erythritol, pentaerythritol, dipentaerythritol, sorbitol, sorbitan, sorbide, a condensate of sorbitol and glycerin, adonitol, arabitol, xylitol, mannitol, or their partially etherified compounds or their partially esterified compounds, sugars such as xylose, arabinose, ribose, ramnose, glucose, fructose, galactose, mannose, sorbose, cellobiose, maltose, isomaltose, trehalose, sucrose, or their partially etherified compounds or their partially esterified compounds are exemplified.

As oxyalkylene groups represented by AO, oxyethylene, oxypropylene, oxytetramethylene, oxystyrene, oxydodecylene, oxytetradecylene, oxyhexadecylene, oxyoctadecylene are exemplified. One or more of these groups may be selected and two or more groups may be bounded at random or in a block arrangement.

As alkenyl groups of 2–5 carbon atoms represented by R, vinyl, allyl, methallyl, 3-butenyl, 4-pentenyl, 3-methyl-4-butenyl are exemplified.

As hydrocarbon groups of 1–24 carbon atoms represented by $R^1$, methyl, ethyl, propyl, isopropyl, butyl, isobutyl, tertiary butyl, amyl, isoamyl, hexyl, heptyl, 2-ethylhexyl, octyl, nonyl, decyl, undecyl, dodecyl, tridecyl, tetradecyl, hexadecyl, isohexadecyl, octadecyl, isooctadecyl, oleyl, octyldodecyl, dococyl, decyltetradecyl, benzyl, cresyl, butylphenyl, dibutylphenyl, octylphenyl, nonylphenyl, dodecylphenyl, dioctylphenyl, dinonylphenyl, styrenated phenyl are exemplified. As acyl groups of 1–24 carbon atoms, there are acyl groups derived from acetic acid, propionic acid, butyric acid, isobutyric acid, caproic acid, enanthic acid, caprylic acid, 2-ethylhexanoic acid, pelargonic acid, capric acid, undecylenic acid, lauric acid, myristic acid, palmitic acid, margaric acid, stearic acid, arachic acid, behenic acid, palmitoleic acid, oleic acid, linoleic acid, linolenic acid, erucic acid, isopalmitic acid, isostearic acid, benzoic acid, hydroxybenzoic acid, cinnamic acid, gallic acid are exemplified.

Polyoxyalkylene alkenyl ether represented by the general formula (1) requires at least an alkenyl group for copolymerizing with maleic anhydride. Since polyoxyalkylene alkenyl ether having two or more alkenyl groups is apt to crosslink these groups, it is difficult to dissolve or disperse the compound in water. When the compound represented by the general formula (1) wherein l is 2 is used, 0.1 moles or less of the compound to 1 mole of the compound represented by the general formula (1) is preferably used. The compounds represented by the general formula (1) wherein l is 3 or more are unsuitable for using because the compounds are easily crosslinked.

The sizing agents of the present invention are characterized in that these agents have functional groups of acid anhydrides. Polyoxyalkylene alkenyl ether represented by the general formula (1) having many hydroxy groups is undesirable, because esterification reaction is occurred and maleic anhydride is consumed when the ether and the acid anhydride are copolymerized. Accordingly, it is required that $n/(l+m+n)$ is $\frac{1}{3}$ or less, preferably n is 0.

The number of hydroxy groups of the polyhydroxy compound having a residue of Z is 8 or less, because the production of the compound represented by the general formula (1) becomes difficult when the number is more than 8. The number of oxyalkylene groups of the self emulsifying sizing agent is at least one. When the average number of the total amount $al+bm+cn$ is above 500, it is hard to handle the agent because the viscosity of the agent increases and it is inconvenient to emulsify. Polyoxyalkylene alkenyl ether represented by the general formula (1) is obtainable by etherifying or esterifying the addition product of alkylene oxide to monovalent alkenyl alcohol, or by etherifying with alkenyl chloride the addition product of alkylene oxide to monovalent alcohol or monovalent carboxylic acid.

Further, polyoxyalkylene alkenyl ether (1) is obtainable by etherifying or esterifying a product which is obtained by adding alkylene oxide to alkenyl ether of a polyhydroxy compound, or by etherifying or esterifying after alkenyl etherifying a product which is obtained by adding alkylene oxide to a polyhydroxy compound. The copolymerization reaction of the ether (1) and maleic anhydride can be conducted by using, for example, a radical catalyst which is disclosed in Japanese Patent Publication No. 45-31950/1970.

In the copolymerization of compound represented by the general formula (1) and maleic anhydride, the molar ratio of these monomers is 3:7-7:3, preferably about 1:1. The weight-average molecular weight of the copolymer is 1,000-1,000,000, preferably 3,000-500,000.

As the sizing agents of the present invention, only one copolymer can be used. However, a copolymer which has a small addition number of alkylene oxides having large sizing effect is preferably used together with a copolymer which has a great addition number of alkylene oxides and is emulsible the above copolymer. The sizing agents of the present invention are usable after emulsifying in water and the usage is usually 0.01-3 wt % based on the amount of pulp. Further, the sizing agents of the present invention include a mixture of the copolymer with emulsible alkenylsuccinic anhydrides represented the general formula (2) or ketene dimers represented by the general formula (3). The mixture of the sizing agent and the compound (2) or the compound (3) can be stably stored over a long period time, and is maintainable good sizing effect.

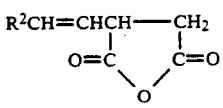

(2)

wherein $R^2$ is an alkyl group of 6-22 carbon atoms.

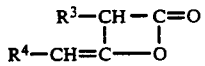

(3)

wherein $R^3$ and $R^4$ are the same or different alkyl groups of 6-22 carbon atoms.

As the alkyl group of 6-22 carbon atoms represented by $R^2$, hexyl , heptyl, octyl, decyl, dodecyl, tetradecyl, hexadecyl, octadecyl, eicosyl and docosyl are exemplified, and these groups may be straight chains or branched chains.

The alkenylsuccinic anhydrides of the general formula (2) are obtainable by the addition reaction of olefins of 8-24 carbon atoms and maleic anhydride.

As the alkyl groups of 6-22 carbon atoms represented by $R^3$ and $R^4$, hexyl, decyl, dodecyl, tetradecyl, hexadecyl, eicosyl and docosyl are exemplified.

The ketene dimers of the general formula (3) are obtainable by a dehydrohalogenation reaction in which a fatty halide such as coconut oil fatty chloride, hardened beef tallow fatty chloride or stearic chloride is reacted with a trialkyl amine.

The carbon numbers of the alkenylsuccinic anhydrides or the alkyl groups of the ketene dimers are limited because the sizing effect is little at the carbon number of less than 6 and the emulsification is lowered at the carbon number of more than 22.

In the sizing agent which is a mixture of an alkenylsuccinic acid or a ketene dimer and a copolymer, the copolymer is 1 wt % or more of the composition, preferably 5 wt % or more. The upper limit is not particularly limited.

Since the sizing agents of the present invention are constituted from the copolymers of polyoxyalkylene alkenyl ethers having a specific structure and maleic anhydride, the agents are self-emulsifiable and have a good sizing effect and the sizing effect is not lowered after storing them over a long period of time.

When the mixture of a copolymer and an alkenylsuccinic anhydride or a ketene dimer is used, in usual emulsifiers, it is necessary to mix immediately before using them because the sizing effect is lowered during the mixture is preserved. The other hand, in the present invention, even if the mixture is preserved over a long period of time after mixing them, the sizing effect is good and not lowered.

BEST MODE FOR CARRYING OUT THE INVENTION

The present invention is illustrated by the following Examples and Comparative Examples.

By using compounds of the general formula (1) shown in Table 1 and compounds of Comparative Examples shown in Table 2, sizing agents which are shown in Table 3 and 4 were prepared.

Paper was treated for sizing by using these sizing agents immediately after preparing them and one month after preparing them by the following method. The extent of sizing of the paper treated was determined.

To a 1.0 wt % slurry of the pulp [the mixture of NBKP (Northern pulp) and LBKP (Southern pulp) in the same amount], 0.2 wt % aqueous emulsion of the sizing agent shown in Table 3 containing 0.2 wt % solids based on pulp and then cationized starch of 0.2 wt % based on the pulp were added. The slurry obtained was manufactured to paper having a weight of 60–62 g/m$^2$ with a tappi standard sheet machine.

The paper obtained was pretreated in accordance with JIS (Japanese Industrial Standard) p8111, and then the Stekihit size of the paper was determined. The results are shown in Table 5.

As shown in Table 5, it was found that the sizing effect of the sizing agents of the present invention was superior to that of the sizing agents of Comparative Examples and it was maintained over a long period of time after preparing the former agents.

INDUSTRIAL APPLICABILITY

As described above, since the self-emulsifying sizing agents of the present invention are preservable over a long period of time and emulsifiable liquid is formed by mixing these agents and water, these agents are suitable for sizing agents for treating paper.

TABLE 1

| No. | Compounds of the general formula (1) |
|---|---|
| 1a | $CH_2{=}CHCH_2O(C_2H_4O)_2C_{18}H_{37}$ |
| 1b | $CH_2{=}CHCH_2O(C_2H_4O)_{20}C_{18}H_{37}$ |
| 2a | $CH_2{=}CHCH_2O(C_3H_6O)_2C_{16}H_{33}$ |
| 2b | $CH_2{=}CHCH_2O(C_2H_4O)_{30}C_{16}H_{33}$ |
| 3a | $CH_2{=}CHCH_2O(C_3H_6O)(C_2H_4O)_2C_{12}H_{25}$ |
| 3b | $CH_2{=}CHCH_2O(C_2H_4O)_{30}C_{16}H_{33}$ |
| 4a | $CH_2{=}CHCH_2O(C_2H_4O)_5C_{20}H_{41}$ |
| 4b | $CH_2{=}CHCH_2O\{(C_3H_6O)_4(C_2H_4O)_{35}\}C_{18}H_{37}$ [1)] |
| 5 | $CH_2{=}CHCH_2O(C_2H_4O)_{20}C_{18}H_{37}$ |
| 6 | $CH_2{=}C(CH_3)CH_2O(C_2H_4O)_{30}{-}C_6H_4{-}C_9H_{19}$ |
| 7 | $CH_2{=}CHCH_2O(C_2H_4O)_{19}(C_3H_6O)_2C_{12}H_{25}$ |
| 8a | $CH_2{=}CHCH_2O\{(C_3H_6O)_3(C_4H_8O)_2\}CH_3$ [2)] |
| 8b | $CH_2{=}CHCH_2O(C_2H_4O)_{15}C_{18}H_{37}$ |
| 9 | $CH_2{=}CHCH_2O\{(C_2H_4O)_{35}(C_3H_6O)_{10}\}C_{24}H_{49}$ |
| 10a | $CH_2{=}CHCH_2O(C_2H_4O)_{10}(C_{12}H_{24}O)C_4H_9$ |
| 10b | $CH_2O(C_2H_4O)_5CH_2CH{=}CH_2$ / $CHO(C_2H_4O)_5H$ / $CH_2O(C_2H_4O)_5COC_{11}H_{23}$ |
| 11 | $CH_2O(C_2H_4O)_{10}CH_2CH{=}CH_2$ / $[CHO(C_2H_4O)_{10}COC_{17}H_{33}]_4$ / $CH_2O(C_2H_4O)_{10}COC_{17}H_{33}$ sorbitol derivative |
| 12 | $CH_2{=}CHCH_2O(C_2H_4O)_9C_{16}H_{33}$ |
| 13 | $CH_2{=}CHCH_2O(C_3H_6O)_8(C_2H_4O)_{11}C_{18}H_{37}$ |
| 14 | $CH_2{=}CHCH_2O(C_2H_4O)_7C_{14}H_{29}$ |
| 15 | $CH_2{=}CHCH_2O(C_2H_4O)_6C_6H_4{-}C_8H_{17}$ |
| 16a | $CH_2{=}CHCH_2O(C_2H_4O)_2C_{18}H_{37}$ |
| 16b | $CH_2{=}CHCH_2O(C_2H_4O)_{20}C_{18}H_{37}$ |
| 17 | $C(CH_2OCH_2C(CH_3){=}CH_2)_3(CH_2O(C_2H_4O)_8COC_{15}H_{31})$ pentaerythritol derivative |

Notes:
1)Random addition is shown by {}.
2)$C_4H_8O$ is a butylene oxide addition product.

TABLE 2

| No. | Compounds of Comparative Examples |
|---|---|
| 18 | $C_9H_{19}{-}C_6H_4{-}O(C_2H_4O)_{10}H$ |
| 19 | $C_{18}H_{37}O(C_2H_4O)_{30}H$ |
| 20 | sodium diisobutylene-maleic acid copolymer |
| 21 | $C_9H_{19}{-}C_6H_4{-}O(C_2H_4O)_8H$ |
| 22a | $C_9H_{19}{-}C_6H_4{-}O(C_2H_4O)_9H$ |
| 22b | $C_{17}H_{33}COOC_2H_4OCOC_{17}H_{33}$ |
| 23a | $C_{30-60}$olefin-maleic anhydride copolymer |
| 23b | $C_9H_{19}{-}C_6H_4{-}O(C_2H_4O)_{12}H$ |
| 24a | $C_{30-60}$olefin-maleic anhydride copolymer |
| 24b | $C_9H_{19}{-}C_6H_4{-}O(C_2H_4O)_{12}H$ |

TABLE 3

| | Compound No. of the general formula (1) | Weight-average molecular weight | Usage 4) | Alkenyl succinic anhydride $R^2$ | Usage 4) |
|---|---|---|---|---|---|
| Example | | Copolymer 3) | | | |
| 1 | 1a | 20,000 | 80 | — | — |
| | 1b | 19,000 | 20 | | |
| 2 | 2a | 40,000 | 70 | — | — |
| | 2b | 15,000 | 30 | | |
| 3 | 3a | 17,000 | 90 | — | — |
| | 3b | 15,000 | 10 | | |
| 4 | 4a | 13,000 | 75 | — | — |
| | 4b | 20,000 | 25 | | |
| 5 | 5 | 19,000 | 8 | $C_{10}H_{21}$ | 92 |
| 6 | 6 | 51,000 | 10 | $C_{12}H_{25}$ | 90 |
| 7 | 7 | 13,000 | 10 | $C_{16}H_{33}$ | 90 |
| 8 | 8a | 24,000 | 35 | $C_{18}H_{37}$ | 50 |
| | 8b | 21,000 | 15 | | |
| 9 | 9 | 18,000 | 12 | $C_{20-24}$ Mix. | 88 |
| 10 | 10a | 8,400 | 20 | $C_{10}H_{21}$ | 75 |
| | 10b | 7,500 | 5 | | |
| 11 | 11 | 86,000 | 16 | $C_{10}H_{21}$ | 84 |
| Comparative Example | | Emulsifier | | | |
| 1 | 18 | — | 10 | $C_{10}H_{21}$ | 90 |
| 2 | 19 | — | 13 | $C_{12}H_{25}$ | 87 |
| 3 | 20 | 8,200 | 10 | $C_{16}H_{33}$ | 90 |

TABLE 4

| | Compound No. of the general formula (1) | Weight-average molecular weight | Usage 4) | Ketene dimer $R^3$ & $R^4$ | Usage 4) |
|---|---|---|---|---|---|
| Example | | Copolymer 3) | | | |
| 12 | 12 | 12,000 | 14 | $C_{16}H_{33}$ | 86 |
| 13 | 13 | 16,000 | 20 | $C_{14}$-$C_{16}$ Mix. | 80 |
| 14 | 14 | 12,000 | 15 | $C_{16}H_{33}$ | 85 |
| 15 | 15 | 30,000 | 15 | $C_{10}$-$C_{12}$ Mix. | 85 |
| 16 | 16a | 20,000 | 10 | $C_{14}$-$C_{16}$ Mix. | 80 |
| | 16b | 19,000 | 10 | | |
| 17 | 17 | 50,000 | 25 | $C_{14}$-$C_{16}$ Mix. | 75 |
| Comparative Example | | Emulsifier 5) | | | |
| 4 | 21 | — | 15 | $C_{16}H_{33}$ | 85 |
| 5 | 22a | — | 15 | $C_{16}H_{33}$ | 70 |
| | 22b | | 15 | | |
| 6 | 23a | 8,000 | 75 | — | — |
| | 23b | | 25 | | |
| 7 | 24a | 8,000 | 20 | $C_{16}H_{33}$ | 60 |

TABLE 4-continued

| Compound No. of the general formula (1) | Weight-average molecular weight | Usage [4] | Ketene dimer $R^3$ & $R^4$ | Usage [4] |
|---|---|---|---|---|
| 24b | 20 | | | |

[3] Copolymers of the compounds of the general formula (1) and maleic anhydride of 1/1 by polymerization molar ratio were used.
[4] The unit of usage wt % by weight.
[5] *In the compounds 23a and 24a of Comparative Examples, copolymers of the compounds and maleic anhydride of 1/1 by polymerization molar ratio were used.*

TABLE 5

| No. | immediately after preparing (sec.) | after one month (sec.) |
|---|---|---|
| Example | | |
| 1 | 23.5 | 23.8 |
| 2 | 22.6 | 23.0 |
| 3 | 24.5 | 23.9 |
| 4 | 22.3 | 21.6 |
| 5 | 21.7 | 21.2 |
| 6 | 20.8 | 18.8 |
| 7 | 21.4 | 20.6 |
| 8 | 19.8 | 18.9 |
| 9 | 21.1 | 19.9 |
| 10 | 19.3 | 16.4 |
| 11 | 19.5 | 19.0 |
| 12 | 26.2 | 25.1 |
| 13 | 23.8 | 23.4 |
| 14 | 24.5 | 23.9 |
| 15 | 20.7 | 19.4 |
| 16 | 26.1 | 25.5 |
| 17 | 24.8 | 22.9 |
| Comparative Example | | |
| 1 | 17.0 | 8.7 |
| 2 | 18.3 | 10.3 |
| 3 | 19.2 | 9.4 |
| 4 | 15.5 | 10.0 |
| 5 | 20.3 | 11.0 |
| 6 | 19.8 | 8.8 |
| 7 | 21.5 | 12.4 |

We claim:

1. A method for sizing paper by using a copolymer of polyoxyalkylene alkenyl ether and maleic anhydride, the polyoxyalkylene alkenyl ether being represented by the general formula (1):

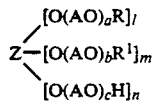

(1)

wherein Z is a residue of compounds having 2–8 hydroxy groups, AO is one or more oxyalkylene groups of 2–18 carbon atoms, with the proviso that the bond of the oxyalkylene groups may be under a random or blocking condition when AO is two oxyalkylene groups or more, R is an alkenyl group of 2–5 carbon atoms, $R^1$ is a hydrocarbon or an acyl group of 1–24 carbon atoms, $a \geqq 0$, $b \geqq 0$, $c \geqq 0$, $l = 1–2$, $m = 0.7$, $0 \leqq n/l(l+m+n) \leqq \frac{1}{3}$, $al+bm+cn = 1–500$ and $l+m+m+n = 2.8$.

2. The method for sizing paper in claim 1, the copolymer is used with an alkenylsuccinic anhydride represented by the general formula (2):

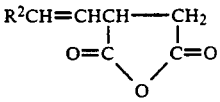

(2)

wherein $R^2$ is an alkyl group of 6–22 carbon atoms.

3. The method for sizing paper in claim 1, the copolymer is used with a ketene dimer represented by the general formula (3):

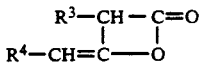

(3)

wherein $R^3$ and $R^4$ are the same or different alkyl group of 6–22 carbon atoms.

4. A self-emulsifying sizing agent composition comprising a copolymer of polyoxyalkylene alkenyl ether represented by the general formula (1) and maleic anhydride, and an alkenylsuccinic anhydride represented by the general formula (2):

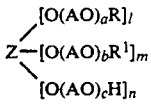

(1)

wherein Z is a residue of compounds having 2–8 hydroxy groups, AO is one or more oxyalkylene groups of 2–18 carbon atoms, with the proviso that the bond of the oxyalkylene groups may be under a random or blocking condition when AO is two oxyalkylene groups or more, R is an alkenyl group of 2–5 carbon atoms, $R^1$ is a hydrocarbon or an acyl group of 1–24 carbon atoms, $a \geqq 0$, $b \geqq 0$, $c \geqq 0$, $l = 1–2$, $m = 0.7$, $0 \leqq n/(l+m+n) \leqq \frac{1}{3}$, $al+bm+cn = 1–500$ and $l+m+n = 2.8$

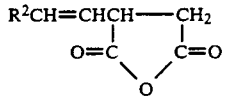

(2)

wherein $R^2$ is an alkyl group of 6–22 carbon atoms.

5. A self-emulsifying sizing agent composition comprising a copolymer of polyoxyalkylene alkenyl ether represented by the general formula (1) and maleic anhydride, and a ketene dimer represented by the general formula (3):

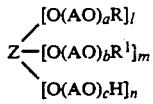

(1)

wherein Z is a residue of compounds having 2–8 hydroxy groups, AO is one or more oxyalkylene groups of 2–18 carbon atoms, with the proviso that the bond of the oxyalkylene groups may be under a random or blocking condition when AO is two oxyalkylene groups or more, R is an alkenyl group of 2–5 carbon atoms, $R^1$ is a hydrocarbon or an acyl group of 1–24 carbon atoms, $a \geqq 0$, $b \geqq 0$, $c \geqq 0$, $l = 1–2$, $m = 0.7$, $0 \leqq n/(l+m+n) \leqq \frac{1}{3}$, $al+bm+cn = 1–500$ and $l+m+n = 2.8$

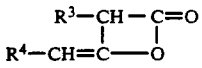

(3)

wherein $R^3$ and $R^4$ are the same or different alkyl group of 6–22 carbon atoms.

* * * * *